US009923288B2

(12) United States Patent
Bertrand et al.

(10) Patent No.: US 9,923,288 B2
(45) Date of Patent: Mar. 20, 2018

(54) ETHERNET CABLE CONNECTOR

(71) Applicant: Garmin Switzerland GmbH, Schaffhausen (CH)

(72) Inventors: Paul M. Bertrand, Olathe, KS (US); Brian B. Barnes, Olathe, KS (US); Samuel T. Pirtle, Shawnee, KS (US)

(73) Assignee: Garmin Switzerland GmbH (CH)

( * ) Notice: Subject to any disclaimer, the term of this patent is extended or adjusted under 35 U.S.C. 154(b) by 0 days.

(21) Appl. No.: 15/294,373

(22) Filed: Oct. 14, 2016

(65) Prior Publication Data

US 2017/0346200 A1 Nov. 30, 2017

Related U.S. Application Data

(60) Provisional application No. 62/340,618, filed on May 24, 2016.

(51) Int. Cl.
*H01R 11/00* (2006.01)
*H01R 11/01* (2006.01)
(Continued)

(52) U.S. Cl.
CPC ..... *H01R 11/01* (2013.01); *H01R 13/052* (2013.01); *H01R 13/111* (2013.01);
(Continued)

(58) Field of Classification Search
CPC ..... H01R 11/01; H01R 13/052; H01R 13/111; H01R 13/5219; H01R 13/59
(Continued)

(56) References Cited

U.S. PATENT DOCUMENTS 6,250,955 B1 * 6/2001 Archuleta ..... H01R 9/03 439/502
8,792,759 B2 * 7/2014 Benton ..... G02B 6/3816 385/101

(Continued)

OTHER PUBLICATIONS

Printout from https://en.wikipedia.org/wiki/Ethernet; published prior to Oct. 14, 2016.

(Continued)

*Primary Examiner* — Abdullah Riyami
*Assistant Examiner* — Nader Alhawamdeh
(74) *Attorney, Agent, or Firm* — Samuel M. Korte; Max M. Ali

(57) ABSTRACT

An Ethernet cable assembly including a cable with nine elongated conductors, a first connector and a second connector located on opposing ends of the cable, and a coupler for electrically coupling with one or both of the connectors. The connectors may each include nine pin receptacles electrically coupled with one of the elongated conductors. The nine receptacles may be arranged with one center receptacle surrounded by eight outer receptacles, symmetrically arranged about a line of symmetry passing through the center receptacle, such that when identical first or second connectors of another cable faces one of the first and second connectors, complementary crossover pairs of the receptacles match up with positive receptacles matching positive receptacles and negative receptacles matching negative receptacles. To couple these identical Ethernet connectors with each other, the coupler may have pins simply passing from one side of the coupler housing to another, without any crossover hardware required therein.

15 Claims, 8 Drawing Sheets

(51) Int. Cl.

| | |
|---|---|
| ***H01R 24/64*** | (2011.01) |
| ***H01R 13/05*** | (2006.01) |
| ***H01R 13/11*** | (2006.01) |
| ***H01R 13/52*** | (2006.01) |
| ***H01R 13/59*** | (2006.01) |
| ***H01R 13/64*** | (2006.01) |
| ***H01R 13/622*** | (2006.01) |
| ***H01R 13/6463*** | (2011.01) |
| ***H01R 24/86*** | (2011.01) |
| *H01R 107/00* | (2006.01) |

(52) U.S. Cl.
CPC ..... *H01R 13/5219* (2013.01); *H01R 13/59* (2013.01); *H01R 13/622* (2013.01); *H01R 13/64* (2013.01); *H01R 13/6463* (2013.01); *H01R 24/64* (2013.01); *H01R 24/86* (2013.01); *H01R 2107/00* (2013.01); *H01R 2201/04* (2013.01)

(58) Field of Classification Search
USPC ..... 439/502
See application file for complete search history.

(56) References Cited

U.S. PATENT DOCUMENTS

2007/0259568 A1* 11/2007 MacKillop ..... H01R 13/6463 439/638
2012/0178317 A1* 7/2012 Skidmore ..... H01R 13/025 439/884
2017/0222370 A1* 8/2017 Johnson ..... H01R 13/641

OTHER PUBLICATIONS

Printout from https://en.wikipedia.org/wiki/Ethernet_physical_layer; published prior to Oct. 14, 2016.
Printout from https://en.wikipedia.org/wiki/Differential_signaling published prior to Oct. 14, 2016.
Printout from https://en.wikipedia.org/wiki/Medium-dependent_interface published prior to Oct. 14, 2016.
Printout from https://en.wikipedia.org/wiki/Modular_connector#8P8C published prior to Oct. 14, 2016.
Printout from http://www.molex.com/molex/products/listview.isp?channel=products&fs=category:industrial%20Cordsets.productseries:or(130048II130054II120108II120109)&sType=z published prior to Oct. 14, 2016.
Printout from http://www.molex.com/molex/products/listview.isp?query=&path=%2Binmeta%3Acategory%3-Dindustrial%252520Cordsets%2Binmeta%3Aproductseries%-3D120341%26partialfields%3D%28productname%3AMicro-Change*%252520%25252BM12%252529%252520Cat6A%29&channel=products published prior to Oct. 14, 2016.
Printout from http://www.mouser.com/pdfdocs/PhoenixContactM12_vs_RJ45_White_Paper.PDF published prior to Oct. 14, 2016.
Printout from https://b2b.harting.com/ebusiness/en/rji-rj45-coupler-pcb-2x-rj45/09455451130 published prior to Oct. 14, 2016.

* cited by examiner

ETHERNET CABLE CONNECTOR

RELATED APPLICATIONS

The current non-provisional patent application claims priority benefit, with regard to all common subject matter, of U.S. Provisional Application No. 62/340,618, titled "IMPROVED ETHERNET CABLE CONNECTOR", and filed May 24, 2016, hereby incorporated by reference in its entirety into the current application.

BACKGROUND

A network of equipment, such as display units, marine sensors, or the like, may include any combination of wired connections and wireless connections. Wired connections require the use of cables having connectors that interface with the equipment in the network. A connector may interface with any equipment having a corresponding input/output interface or port. Marine equipment and other equipment requiring high data communication may utilize a protocol such as Ethernet. The connector for an Ethernet cable may be standardized, such as the RJ45 connector, or custom.

Ethernet cables typically consist of a plurality of conductors. One common Ethernet cable style has eight conductors and a shield (ground). The conductors may be split into four pairs that are twisted and used to relay different signals. Two complementary signals may be used to send data, with one signal being a positive voltage and the other being a negative voltage. This helps reduce electromagnetic interference because the interference acts on both signals equally so the difference between the two remains constant.

When connecting Ethernet cables, a positive signal of a wire pair in one cable should connect to the positive signal in the wire pair of the other cable, and the same for the negative signal. In some applications, two identical types of Ethernet connectors at the ends of the Ethernet cables may be connected using a crossover cable therebetween, so that the receive (RX) and transmit (TX) pairs are swapped. Other methods for making proper connections between connectors of two Ethernet cables may additionally or alternatively use a printed circuit board with two connectors and copper traces running in between or a short section of Ethernet cable that is wired appropriately to the two connectors. Both of these have drawbacks in cost and reliability.

SUMMARY

An Ethernet cable assembly is disclosed for coupling two Ethernet connectors without requiring a crossover cable. The Ethernet cable assembly broadly includes a cable having a number of conductors, first and second connectors on opposite ends of the cable, and a coupler. The coupler may be physically and electrically connected to either the first connector or the second connector.

In embodiments, an Ethernet cable assembly may include a cable including nine conductors, a first connector coupled with a first end of the cable and a second connector coupled with a second end of the cable. The first and second connectors may each comprise a non-conductive housing, an alignment element associated with the pin-receptacle-supporting face, and nine pin receptacles supported on the pin-receptacle-supporting face, the pin receptacles each electrically coupled with one of the conductors. The pin receptacles may include a center pin receptacle and a plurality of outer pin receptacles circumferentially-spaced around the center pin receptacle in a symmetrical fashion. The outer pin receptacles may include a first pin receptacle, a second pin receptacle, a third pin receptacle, a fourth pin receptacle, a fifth pin receptacle, a sixth pin receptacle, a seventh pin receptacle, and an eighth pin receptacle. A third conductor and a fourth conductor may be formed into a first twisted pair, a first conductor and a second conductor may be formed into a second twisted pair, a seventh conductor and a eighth conductor may be formed into a third twisted pair, and a fifth conductor and a sixth conductor may be formed into a fourth twisted pair.

In other embodiments, an Ethernet cable assembly may include a cable including nine conductors, a first connector coupled with a first end of the cable, a second connector coupled with a second end of the cable, and a coupler configured for physically and electrically connecting to either the first connector or the second connector. The first and second connectors may each comprise a non-conductive housing, an alignment element associated with the pin-receptacle-supporting face, and nine pin receptacles supported on the pin-receptacle-supporting face, the pin receptacles each electrically coupled with one of the conductors. The pin receptacles may include a center pin receptacle and a plurality of outer pin receptacles circumferentially-spaced around the center pin receptacle in a symmetrical fashion. The outer pin receptacles may comprise a first pin receptacle, a second pin receptacle, a third pin receptacle, a fourth pin receptacle, a fifth pin receptacle, a sixth pin receptacle, a seventh pin receptacle, and an eighth pin receptacle.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present technology will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 1:
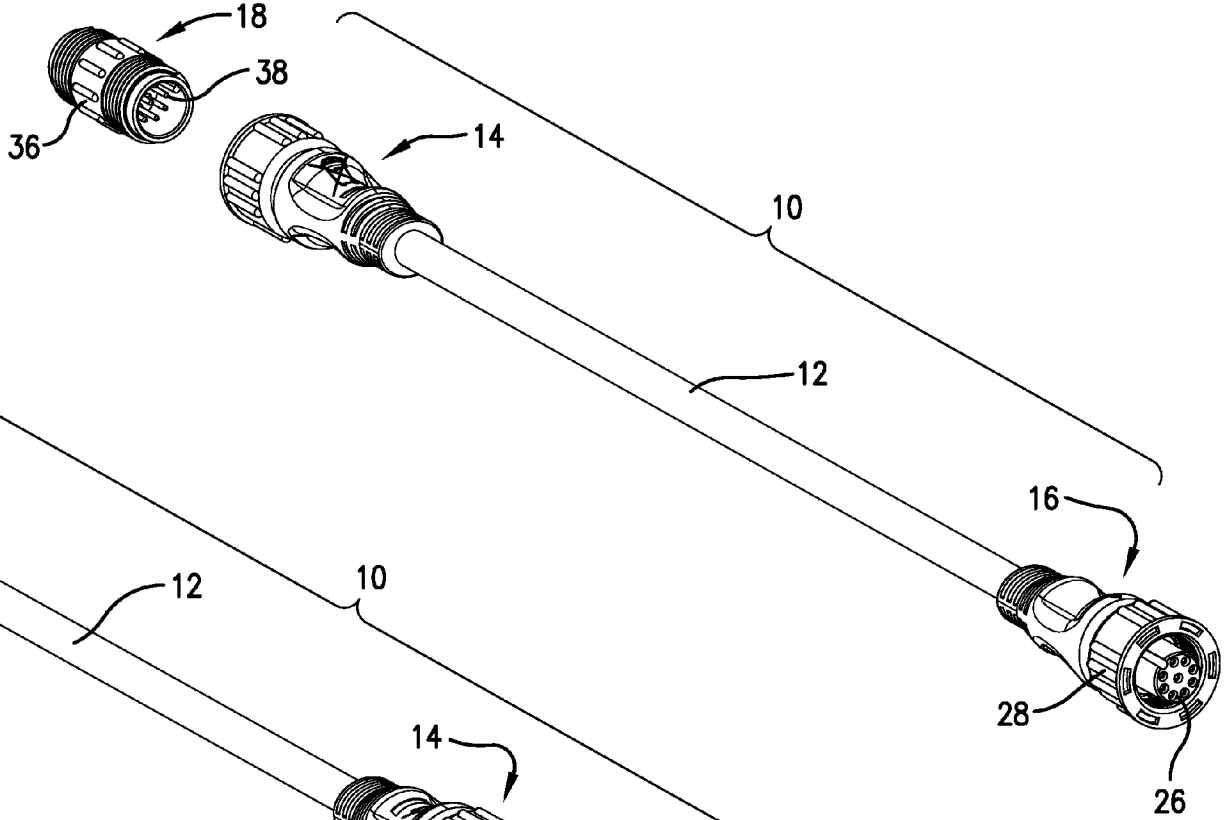
FIG. 1 is a front perspective view of a an Ethernet cable assembly constructed in accordance with various embodiments of the present technology.

The drawing figures do not limit the present technology to the specific embodiments disclosed and described herein. The drawings are not necessarily to scale, emphasis instead being placed upon clearly illustrating the principles of the technology.

DETAILED DESCRIPTION

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the present technology. The following detailed description is, therefore, not to be taken in a limiting sense. The scope of the present technology is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present technology relate to Ethernet cables and couplers. When connecting various Ethernet cables, keeping track of the various crossover configurations may lead to confusion and faulty installation. A mechanism called Auto MDI-X was developed for this problem. This mechanism is typically built into modern Ethernet hardware for auto-detecting pairs and making a proper connection between two connectors. With this mechanism in mind, the present technology was developed with pins or pin receptacles arranged in such a way that when two identical connectors face each other, the complementary crossover pairs (2 and 3, 1 and 4) match up, with positive pins or receptacles matching positive pins or receptacles and negative pins or receptacles matching negative pins or receptacles. This is achieved using a special pin or pin receptacle order as well as a mechanical key design to ensure the connectors are symmetric across a line of symmetry. This symmetrical arrangement of the pins or receptacles enable use of an Ethernet coupler that simply includes pins that pass from one side to the other, without any additional hardware or crossing of connections therein. Any mismatch between send and receive is resolved via the hardware's Auto MDI-X or similar pair auto-detecting device. Prior to the present technology, it was necessary to route the pins or receptacles of an Ethernet cable by using a custom printed circuit board (PCB) or by using two connectors and a short piece of specially-wired cable to make the proper connections between the two cables' connectors. Advantageously, the simplified design of the present technology reduces manufacturing cost, improves reliability, and prevents assembly issues.

A first and second connectors may each have a non-conductive housing, an alignment element, and a plurality of pin receptacles held in spaced relationship to each other via the non-conductive housing. The non-conductive housing may have an outer connector body and a pin-receptacle-supporting face within the outer connector body. The pin-receptacle-supporting face presents a center and a line of symmetry passing through the center. The alignment element may mate with an alignment element of the coupler to properly orient the coupler and the first or second connector. The pin receptacles are supported on the pin-receptacle-supporting face and are each electrically coupled with one of the conductors.

The pin receptacles may include a center pin receptacle supported near the center of the pin-receptacle-supporting face and a plurality of outer pin receptacles that are radially spaced from and circumferentially-spaced around the center pin receptacle in a symmetrical fashion about the line of symmetry. For example, a first and an eighth pin receptacle may be located opposite one another across the line of symmetry, a second and a seventh pin receptacle may be located opposite one another across the line of symmetry, a third and a sixth pin receptacle may be located opposite one another across the line of symmetry, and a fourth and a fifth pin receptacle may be located opposite one another across the line of symmetry such that the first, second, third, and fourth pin receptacles form a mirror image of the eighth, seventh, sixth, and fifth pin receptacles relative to the line of symmetry.

The coupler may include a non-conductive housing having first and second ends and at least one alignment element that cooperatively mates with the alignment elements on the first and second connectors. An embodiment of the coupler also includes nine elongated pins extending between the first and second ends of the coupler's housing. The pins may be arranged to physically and electrically couple with the pin receptacles of the first or the second connectors when either the first or second end of the coupler is connected to either the first connector or the second connector. This permits the simple coupler to connect two Ethernet cables together without requiring cross-over wiring, custom PCB connections, or other additional cabling connected therebetween.

In one embodiment, a first pin receptacle of a first connector and a eighth pin receptacle of a second connector are connected to opposite ends of a first conductor; a second pin receptacle of the first connector and a seventh pin receptacle of the second connector are connected to opposite ends of a second conductor; a third pin receptacle of the first connector and a sixth pin receptacle of the second connector are connected to opposite ends of a third conductor; a fourth pin receptacle of the first connector and a fifth pin receptacle of the second connector are connected to opposite ends of a fourth conductor; a fifth pin receptacle of the first connector and a fourth pin receptacle of the second connector are connected to opposite ends of a fifth conductor; a sixth pin receptacle of the first connector and a third pin receptacle of the second connector are connected to opposite ends of a sixth conductor; a seventh pin receptacle of the first connector and a second pin receptacle of the second connector are connected to opposite ends of a seventh conductor; an eighth pin receptacle of the first connector and a first pin receptacle of the second connector are connected to opposite ends of an eighth conductor; and a center pin receptacle of the first connector and a center pin receptacle of the second connector are connected to opposite ends of a ninth conductor.

Figure 2:
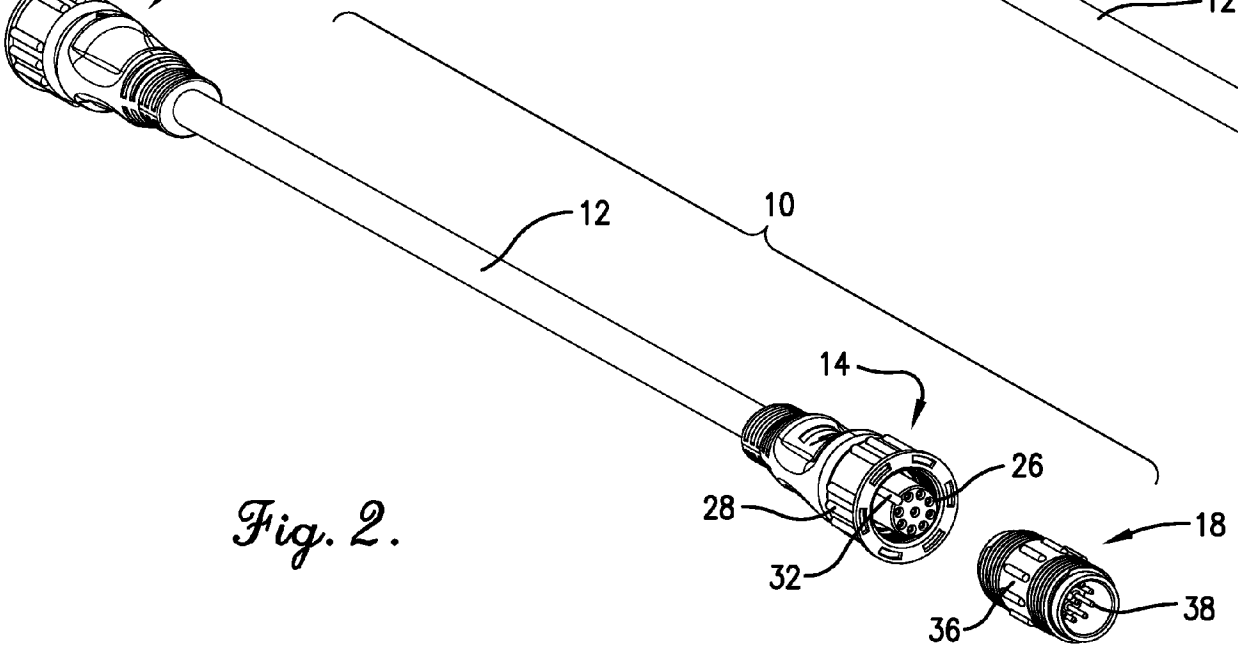
FIG. 2 is a rear perspective view of the Ethernet cable assembly of FIG. 1.

Embodiments of the technology will now be described in more detail with reference to the drawing figures. Referring initially to FIGS. 1 and 2, an Ethernet cable assembly 10, constructed in accordance with embodiments of the present technology, broadly comprises an Ethernet cable 12, a first connector 14 at a first end of the Ethernet cable 12, a second connector 16 at a second end of the Ethernet cable 12, and an Ethernet coupler 18 configured to couple with one or both of the first and second connectors 14, 16 or similar connectors on other Ethernet cables.

The Ethernet cable 12, as illustrated in FIGS. 1-4 and 7-9, may comprise a plurality of elongated conductors 20, each electrically isolated from one another. In some embodiments of the technology, the elongated conductors 20 may be wires, such as copper wires with non-conductive shielding 22 wrapped around the wires. Any wire diameter may be used, such as 24 American wire gauge (AWG) or between 0.25 to 0.75 mm. The insulation or shielding 22 may have a thickness of approximately 0.245 or a thickness in a range of 0.2 to 0.3 mm. The wires may be arranged in twisted pairs, such that one of the wires in the twisted pair is used for transmitting a positive voltage signal and another one of the wires in the twisted pair is used for transmitting a corresponding negative voltage signal.

In one embodiment, the cable 12 includes nine elongated conductors 20 configured for transmitting various electrical signals thereon. The shielding 22 of each of the nine elongated conductors 20 may have different colors and patterns corresponding to the signals carried thereby. For example, the elongated conductors 20 may comprise a first conductor 101 that is white with an orange stripe and is configured to carry a BI_DA+ data signal, a second conductor 102 that is orange and is configured to carry a BI_DA− data signal, a third conductor 103 that is blue and is configured to carry a BI_DC+ data signal, a fourth conductor 104 that is white with a blue stripe and is configured to carry a BI_DC− data signal, a fifth conductor 105 that is brown and is configured to carry a BI_DD− data signal, a sixth conductor 106 that is white with a brown stripe and is configured to carry a BI_DD+ data signal, a seventh conductor 107 that is green and is configured to carry a BI_DB− data signal, an eighth conductor 108 that is white with a green stripe and is configured to carry a BI_DB+ data signal. Furthermore, the third conductor 103 and the forth conductor 104 may be formed into a first twisted pair 201, the first conductor 101 and the second conductor 102 may be formed into a second twisted pair 202, the seventh conductor 107 and the eighth conductor 108 may be formed into a third twisted pair 203, and the fifth conductor 105 and the sixth conductor 106 may be formed into a fourth twisted pair 204. The elongated conductors 20 may also include a ninth conductor 109 configured to serve as a shield for the cable 12.

Note that BI_DA+, as used herein, represents bidirectional pair +A signal. BI_DA−, as used herein, represents bidirectional pair −A signal. BI_DB+, as used herein, represents bidirectional pair +B signal. BI_DB−, as used herein, represents bidirectional pair −B signal. BI_DC+, as used herein, represents bidirectional pair +C signal. BI_DC−, as used herein, represents bidirectional pair −C signal. BI_DA+, as used herein, represents bidirectional pair +D signal. BI_DD−, as used herein, represents bidirectional pair −D signal. Signals A, B, C, and D may correspond with pairs two, three, one, and four, respectively.

The first connector 14 and the second connector 16 may each include a non-conductive connector housing 24 and a plurality of pin receptacles 26 extending therethrough and electrically coupled to one of the elongated conductors 22. The connector housing 24 may have an outer connector body 25, at least one pin-receptacle-supporting face 27 within the outer connector body 25, and a first alignment element 32.

The outer connector body 25 may be made of plastic or other non-conductive materials and may have a substantially cylindrical configuration that may narrow proximate to the conductors 20. However, the outer connector body 25 may have other shapes or configurations without departing from the scope of the technology described herein. In some embodiments of the technology, screw threads or other mechanical fastening features may be molded into or attached to an outer or inner surface of the outer connector body 25, such that a threaded nut 28 or the like may attach thereto.

The pin-receptacle-supporting face 27 may also be made of plastic or other non-conductive materials and presents a center 33 and a line of symmetry 34 passing through the center 33, as later described herein. The pin-receptacle-supporting face may have a substantially circular configuration, molded around the pin receptacles 26 and/or presenting holes through which the pin receptacles 26 may extend. However, in some embodiments of the technology, the connector housing 24 may have other shapes or configurations required for a given application.

In some embodiments, the first alignment element 32 may be made of the same material as the outer connector body 25 and/or the pin-receptacle-supporting face 27. The first alignment element 32 may be a portion of a mechanical key that extends from or is formed into the pin-receptacle-supporting face 27 and/or the outer connector body 25. For example, the first alignment element 32 may be an alignment indention or an alignment protrusion molded into or onto the outer connector body 25 and/or the pin-receptacle-supporting face 27 and may serve to cooperatively maintain a desired orientation with the coupler 18, as later described herein.

Figure 13:
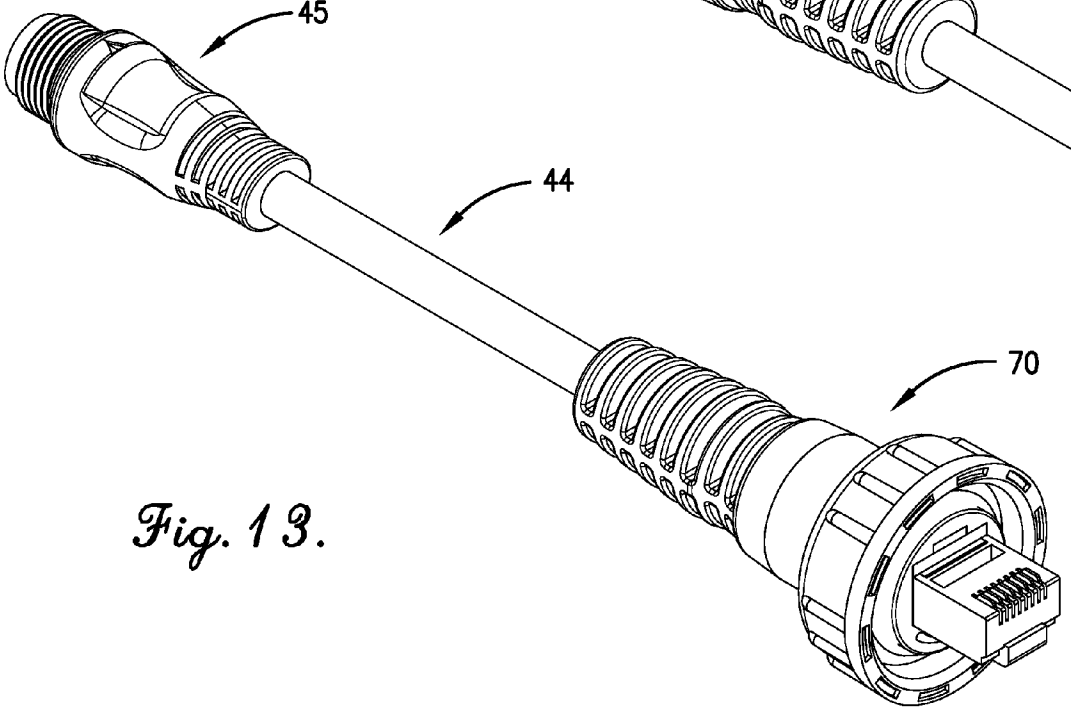
FIG. 13 is a rear perspective view of the marine network connector adapter of FIG. 12.
Figure 14:
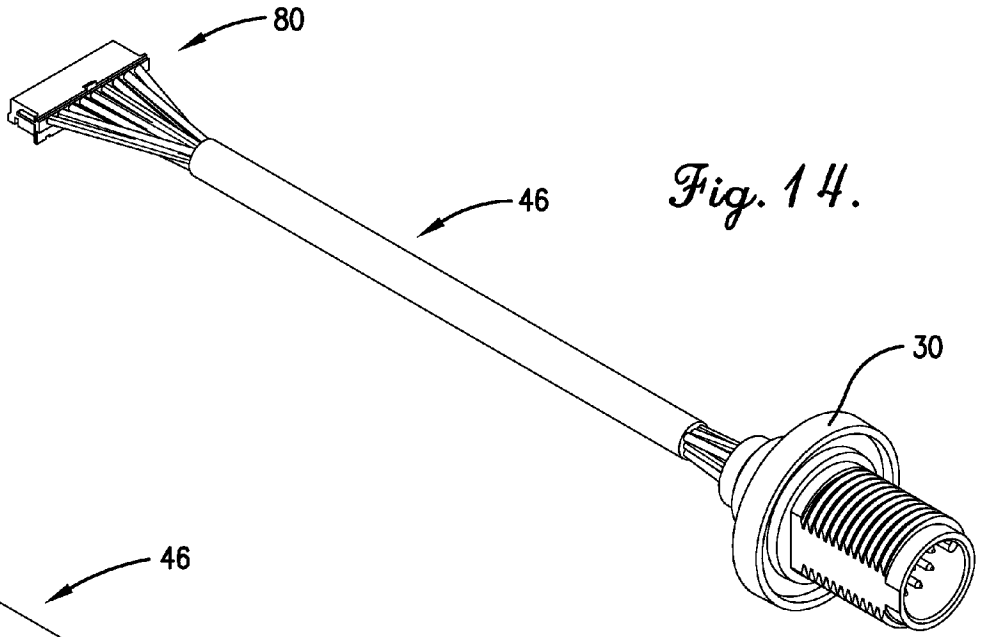
FIG. 14 is a front perspective view of a wire harness adapter constructed in accordance with embodiments of the present technology.

In some embodiments of the technology, the connector housing 24 may further include a rubber o-ring or the like which may be placed around the outer connector body 25 to protect the pin receptacles 26 from water. The connector housing 24 may also include a collar or threaded nut 28 used to secure the first and/or second connectors 14, 16 to each other and/or the coupler 18, later described herein, or to secure the first or second connector 14, 16 to another Ethernet connector, such as a bulkhead connector 30, as illustrated in FIGS. 13 and 14. The collar or threaded nut 28 may be made of plastic or other non-conductive materials. A metal collar or threaded nut 28 may be used in some alternative embodiments of the technology described herein.

Figure 3:
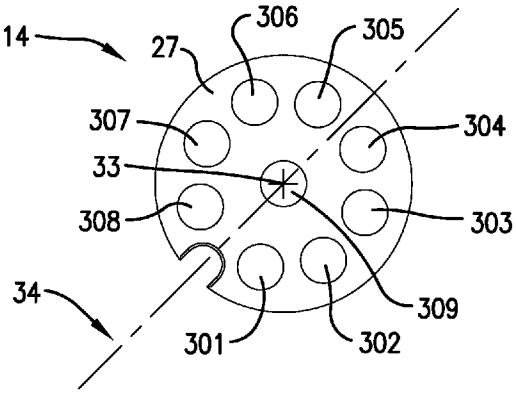
FIG. 3 is an end view of a first connector of the Ethernet cable assembly of FIG. 1.
Figure 4:
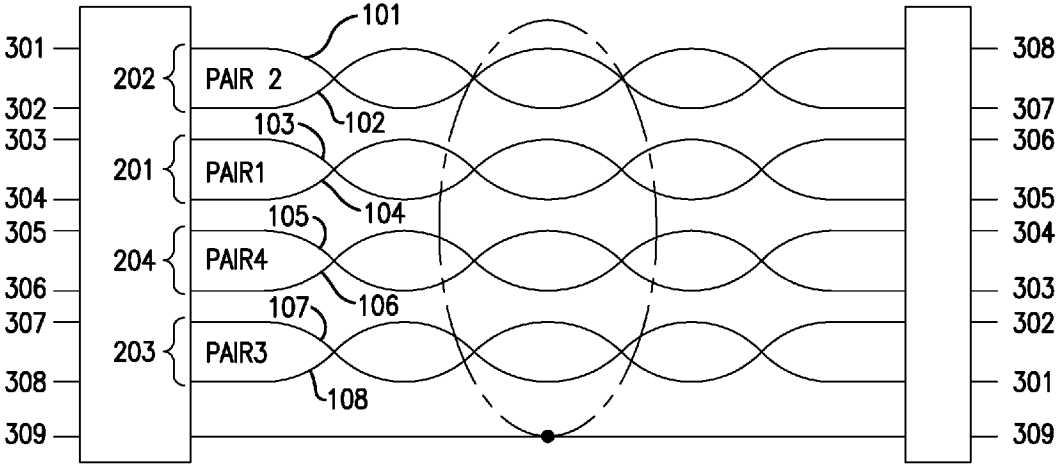
FIG. 4 is a schematic view of the Ethernet cable of FIG. 1, illustrating how elongated conductors are wired with the first connector and a second connector.
Figure 6:
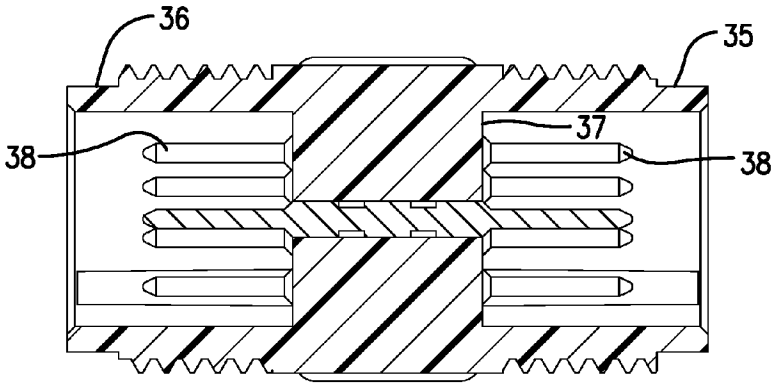
FIG. 6 is a cross-sectional view of the coupler, taken along line 6-6 of FIG. 5.

The pin receptacles 26 may include an arrangement of nine pin receptacles, each electrically coupled at one end of one of the elongated conductors 20. For example, as illustrated in FIG. 3, the first and second connectors 14, 16 may each have nine pin receptacles 26 extending through the pin-receptacle-supporting face 27, and may include eight outer receptacles 301, 302, 303, 304, 305, 306, 307, 308 and one center receptacle 309. The center receptacle 309 may be a ground receptacle and may be located at the center 33. The eight outer receptacles 301-308 may include a first receptacle 301, a second receptacle 302, a third receptacle 303, a fourth receptacle 304, a fifth receptacle 305, a sixth receptacle 306, a seventh receptacle 307, and an eight receptacle 308.

The connector housing 24 may support the center receptacle 309 in a central location relative to the outer receptacles 301-308 and may support the outer receptacles 301-308 to be radially-spaced from the center receptacle 309 and circumferentially spaced around the center receptacle 309 in a symmetrical fashion about the line of symmetry 34. For example, the line of symmetry 34 may pass through the center receptacle 309 and the first alignment element 32. The first receptacle 301, the second receptacle 302, the third receptacle 303, and the fourth receptacle 304 may form a mirror image with and are located to an opposite side of the line of symmetry 34 than the eighth receptacle 308, the seventh receptacle 307, the sixth receptacle 306, and the fifth receptacle 305, respectively. The center receptacles 309 of the first and second connectors 14, 16 may be configured to serve as a drain and the ninth conductor 109 may extend between the center receptacles 309 of the first and second connectors 14,16, acting as a shield for the cable 12.

The Ethernet cable 12, the first connector 14, and the second connector 16 may have any total length required for a given application. In some embodiments of the technology, the total length may be in a range of 1 meter (m) to 100 m. For example, the total length may be 2 m±25 millimeters (mm), 6 m±40 mm, or 12 m±50 mm. The cable 12 and connectors 14, 16 may be of other lengths without departing from the scope of the technology described herein.

An embodiment of the coupler 18 is illustrated in FIGS. 1-2 and 5-9 and may include a non-conductive coupler housing 36 and a plurality of conductive pins 38. The coupler housing 36 may include an outer coupler body 35 and a pin-supporting face 37, supporting the conductive pins 38 in a spaced relation identical to the spacing and configuration of the pin receptacles 26 described above. The outer coupler body 35 may be substantially cylindrical and the pin-supporting face 37 may be substantially circular within the cylindrical shape of the outer coupler body 35. However, other shapes, sizes, and configurations may be used without departing from the scope of the technology described herein. In some embodiments of the technology, screw threads or other mechanical fastening features may be molded into or attached to an outer or inner surface of the coupler housing 36, such that the threaded nut 28 may attach thereto.

The coupler housing 36 may also include another portion of the mechanical key noted above. This second portion may be referred to herein as a second alignment element 40, extending therefrom or formed therein. For example, the second alignment element 40 may include an alignment indention or an alignment protrusion molded into or on the outer coupler body 35 and/or the pin-supporting face 37 for cooperatively maintaining a desired orientation with one of the connectors 14, 16. Specifically, in one embodiment of the technology, the first alignment element 32 of one or both of the connectors 14, 16 comprises an alignment protrusion and the second alignment element 40 of the coupler 18 comprises an alignment indention sized, shaped, and configured to slidably mate with the alignment protrusion. In another embodiment of the technology, the first alignment element 32 of one or both of the connectors 14, 16 comprises an alignment indention and the second alignment element 40 of the coupler 18 comprises an alignment protrusion sized, shaped, and configured to slidably mate with the alignment indention. The alignment protrusions and indentions illustrated in FIGS. 1-3 and 5-6 have a substantially C-shaped or half-circle-shaped configuration. However, other shapes, sizes, and configurations may be used without departing from the scope of the technology described herein.

Figure 5:
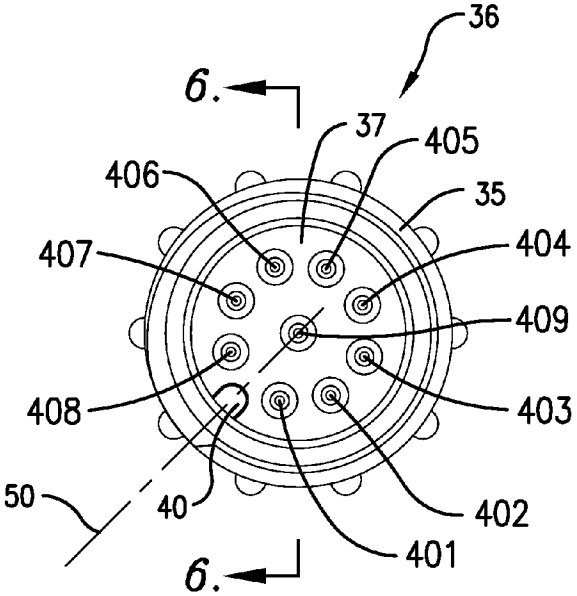
FIG. 5 is an end view of a coupler of the Ethernet cable assembly of FIG. 1.

As illustrated in FIG. 5, an embodiment of the coupler 18 may include nine pins 38 extending through the coupler housing 36 or its supporting face 37, configured for physically and electrically connecting the first connector 14 with the second connector 16 or with identical connectors of another substantially identical Ethernet cable with connectors configured as described herein. The nine pins 38 may be arranged, sized, and shaped to directly physically and electrically couple with the pin receptacles 26 of one or both of the first and second connectors 14, 16. That is, the pins 38 of the coupler 18 may include a center pin 409 with eight outer pins 401, 402, 403, 404, 405, 406, 407, 408 arranged around the center pin 409 at a same radial distance and circumferential spacing as the receptacles 301-308 of the first and second connectors 14, 16. Likewise, the second alignment element 40 may be located along a line of symmetry 50 of the eight outer pins 401-408, insuring alignment of the coupler's pins 38 with the connector's pin receptacles 26.

Figure 7:
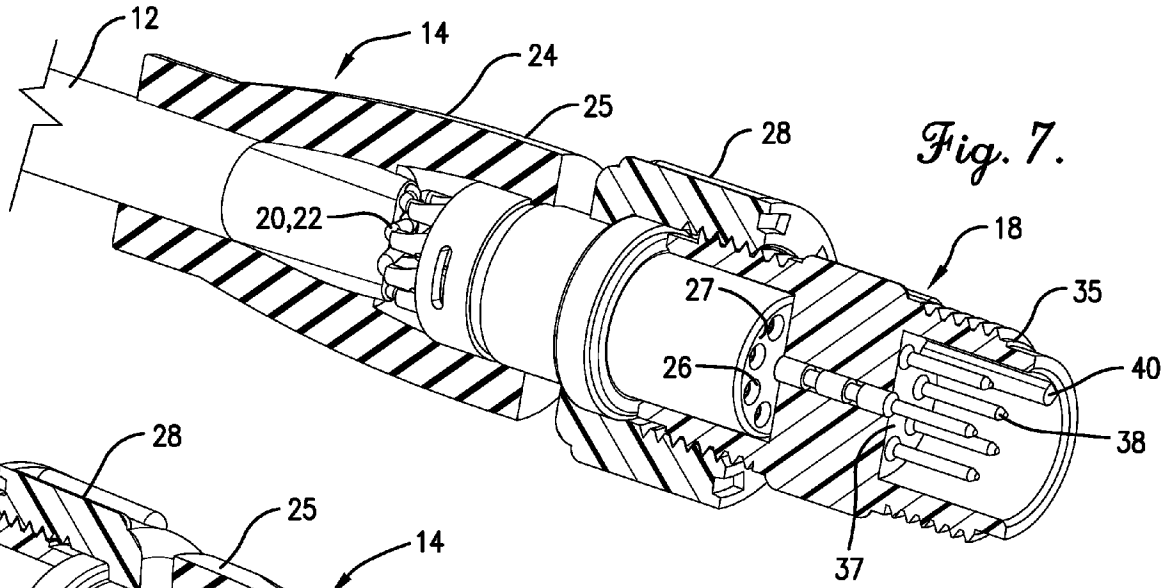
FIG. 7 is a partial cross-sectional view showing one end of the coupler coupled with the first connector.
Figure 8:
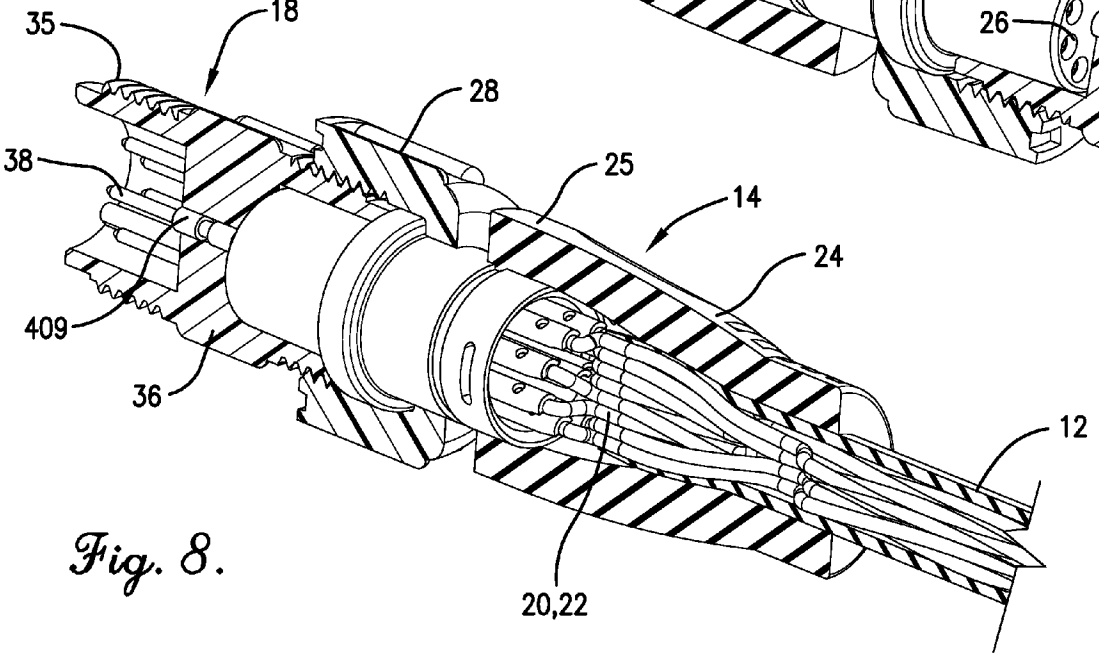
FIG. 8 is a partial cross-sectional view showing the second end of the coupler coupled with the first connector.
Figure 9:
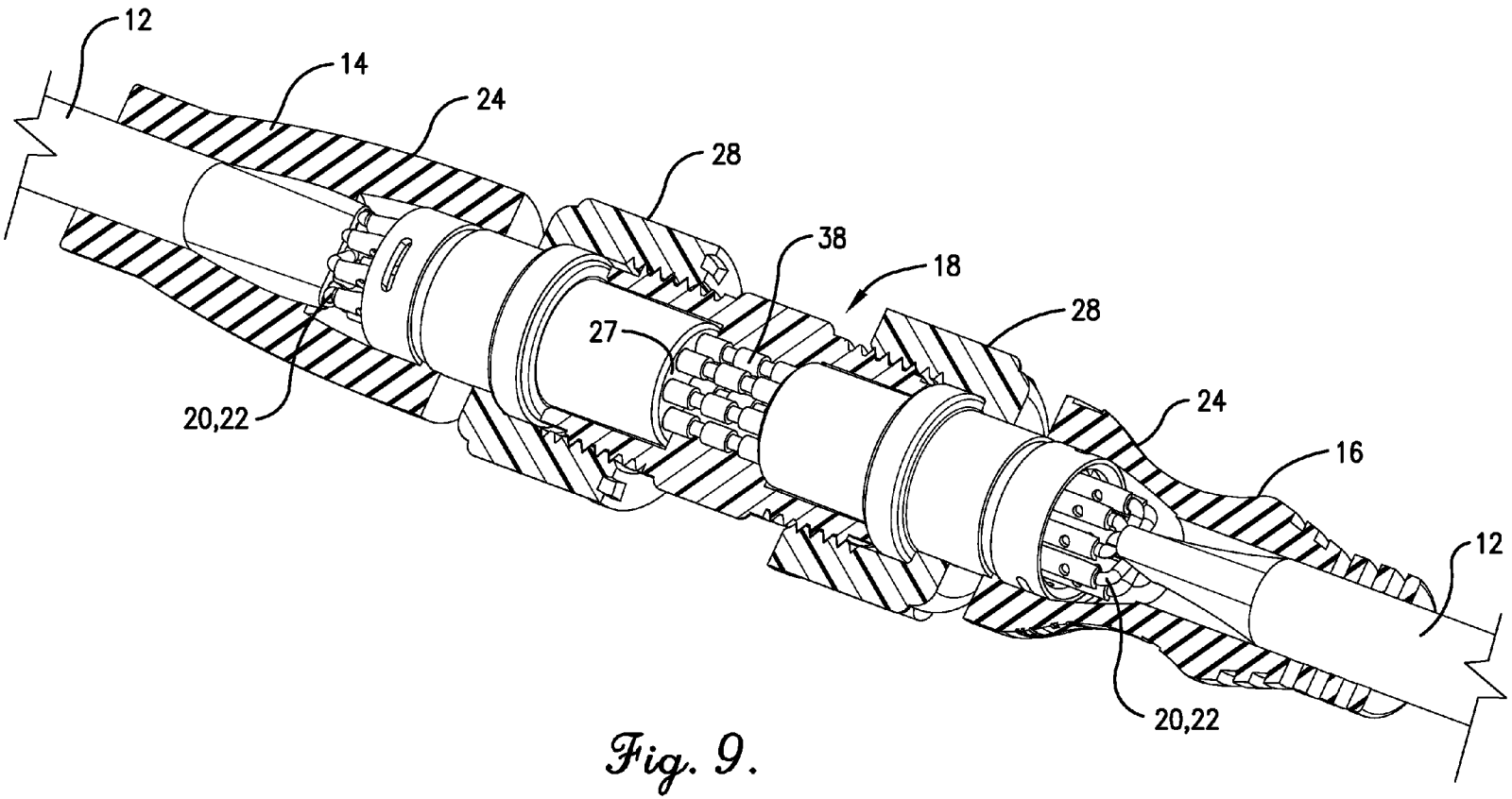
FIG. 9 is a partial cross-sectional view showing both ends of the coupler connected to the first and second connectors.

In use, multiple Ethernet cables 12 or other cables having connectors arranged as described herein may be physically and electrically connected via the coupler 18. First, the first connector 14 is connected with the first end of the coupler 18, as illustrated in FIGS. 7-8, with the first alignment element 32 sliding into the second alignment element 40. Then, the second connector 16 is connected with the coupler 18 at the second end of the coupler 18, as illustrated in FIG. 9. Then, the threaded nut 28 is rotated to screw into the threads on the connector housing 24 and/or on the coupler housing 36. Other mechanical fasteners may be used without departing from the scope of the invention. The mechanical fasteners and other components associated with the housings 24,36 may be configured to be substantially waterproof and to form a substantially waterproof connection, such that water is prevented from contacting the receptacles 26 and the pins 38 of the assembly 10. For example, a plastic collar or threaded nut 28 may form a waterproof connection with the coupler 18, a rubber o-ring, and the first connector 14 and/or the second connector 16.

Due to the arrangement of the pin receptacles 26 in the connectors 14,16, the coupler 18 may be used to couple two Ethernet cables together without requiring cross-over wiring, custom PCB connections therebetween or other additional cabling connected therebetween. Specifically, because of the symmetrical configuration of the pin receptacles 26 and the pins of the Ethernet cable assembly 10, complementary crossover pairs (e.g., pairs two and three, pairs one and four) match up with positive pin receptacles matching positive pin receptacles and negative pin receptacles matching negative pin receptacles. The Auto MDI-X or other such mechanisms in most modern Ethernet devices and hardware are configured to swap complementary pairs of pins or pin receptacles 26 (i.e., swapping the send and receive assignments), so this design advantageously utilizes that functionality while also eliminating the need for more complex couplers between the two cable connectors. Furthermore, the non-conductive housings are not used as shields, as in other prior art Ethernet connectors with metal housings, thus reducing the cost of the housings, which may be made of plastic.

The above-described Ethernet cable assembly 10 may also be used with adapter cables to allow hardware ports using other styles of Ethernet connectors to be coupled with the first or second connectors 14, 16. Specifically, adapter cables 42, 44, 46 constructed in accordance with other embodiments of the technology are illustrated in FIGS. 10-15 and may couple one of the connectors 14, 16 to various Ethernet hardware devices or traditional Ethernet connectors.

Figure 10:
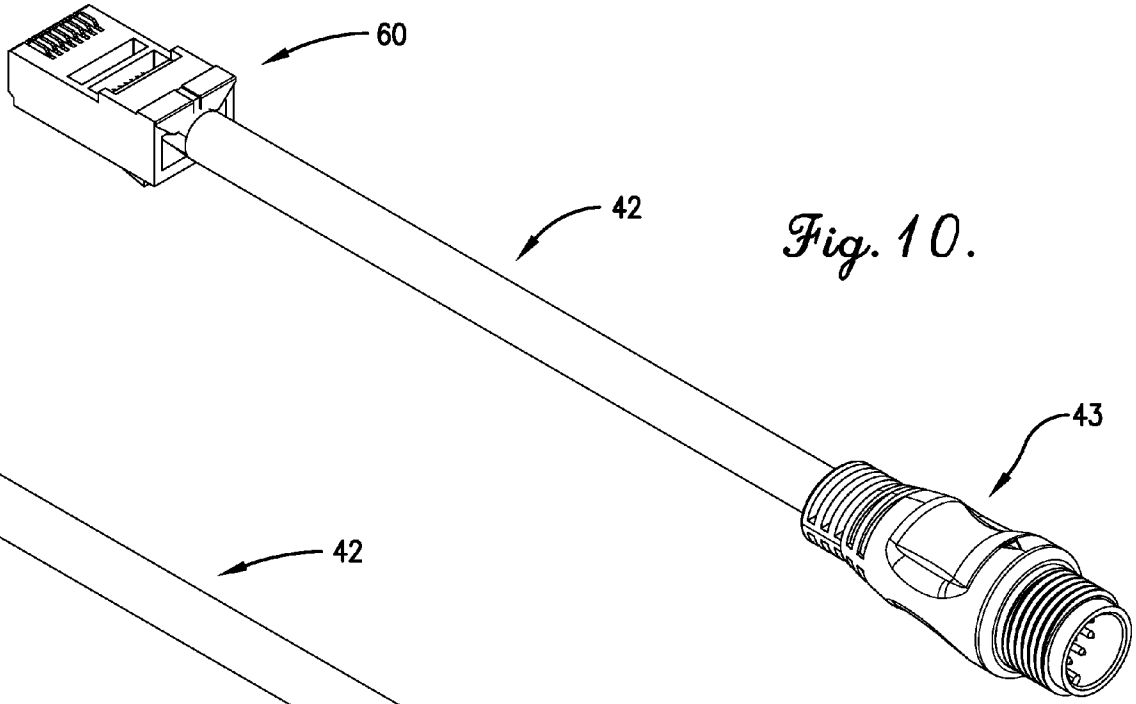
FIG. 10 is a front perspective view of an RJ45 adapter constructed in accordance with embodiments of the present technology.
Figure 11:
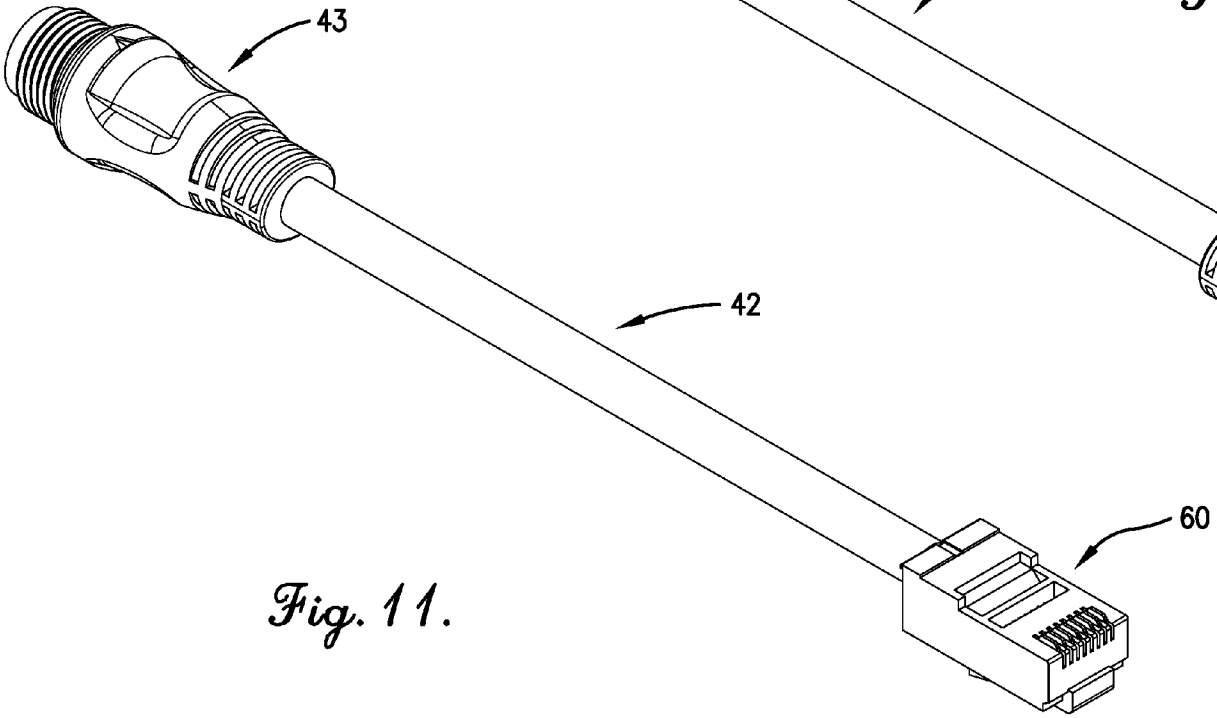
FIG. 11 is a rear perspective view of the RJ45 adapter of FIG. 10.

For example, as illustrated in FIGS. 10-11, the adapter cable 42 may include elongated conductors, a coupler 43 identical to the coupler 18, and a traditional RJ45 Ethernet connector 60. The coupler 43 may be physically connected or hardwired at a first end of the conductors and the traditional RJ45 Ethernet connector 60 may be hardwired to a second end of the conductors of the adapter cable 42. The coupler 43 hardwired to the conductors for the cable 42 may alternatively be replaced with another cable end connector having an identical pin arrangement to the coupler 18.

Figure 12:
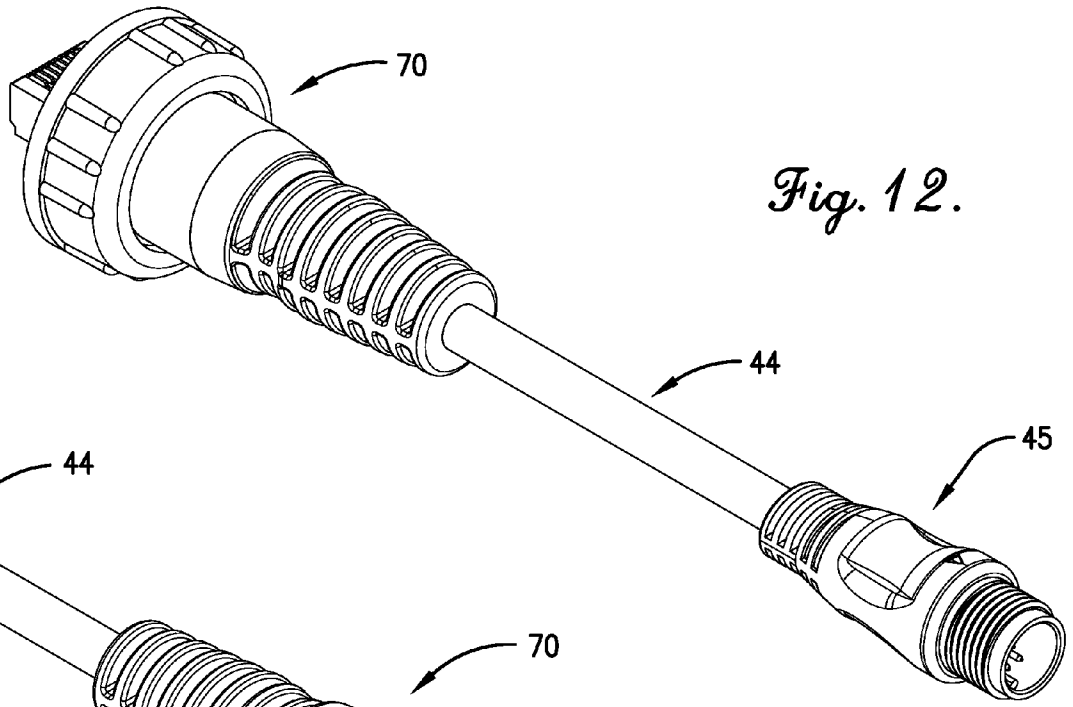
FIG. 12 is a front perspective view of a marine network connector adapter constructed in accordance with embodiments of the present technology.

In another embodiment of the technology illustrated in FIGS. 12-13, the adapter cable 44 may include elongated conductors, a coupler 45 identical to the coupler 18, and some type of marine network connector 70. The coupler 45 may be hardwired to a first end of the conductors the marine network connector 70 may be hardwired to a second end of the conductors. The coupler 45 hardwired to the conductors for the cable 44 may alternatively be replaced with another cable end connector having an identical pin arrangement to the coupler 18.

Figure 15:
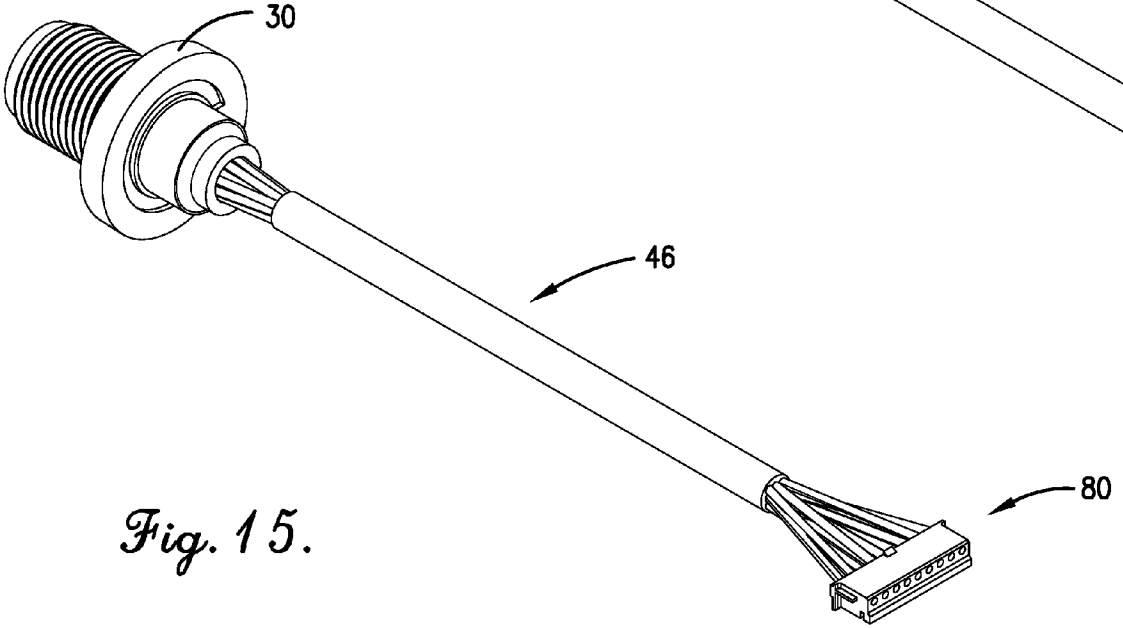
FIG. 15 is a rear perspective view of the wire harness adapter of FIG. 14.

In yet another embodiment of the technology illustrated in FIGS. 14-15, the adapter cable 46 may include elongated conductors, the bulkhead connector 30, and a wire harness 80. The bulkhead connector 30 may be hardwired to a first end of the conductors and a wire harness 80 may be hardwired to a second end of the conductors. Alternatively, the second end of the adapter cables 42-46 above may include a traditional D-coded M12, A-coded M12, X-coded M12, or any type of Ethernet connector known in the art.

Although the technology has been described with reference to the embodiments illustrated in the attached drawing figures, it is noted that equivalents may be employed and substitutions made herein without departing from the scope of the technology as recited in the claims. For example, although the Ethernet cable 12 is described herein as having female connectors 14,16 with pin receptacles 26, note that one or both of the connectors 14,16 may be replaced with male connectors having identically-spaced and arranged pins protruding from the housing thereof without departing from the scope of the technology described herein. Furthermore, the coupler 18 is illustrated as a two-sided male coupler herein, but may be replaced with a two-sided female coupler having a housing with nine receptacles extending therethrough, having identical spacing and arrangement to the pins 38 described above, without departing from the scope of the technology described herein.

Having thus described various embodiments of the technology, what is claimed as new and desired to be protected by Letters Patent includes the following:

What is claimed is:

1. An Ethernet cable assembly comprising:

a cable including nine conductors;

a first connector coupled with a first end of the cable; and a second connector coupled with a second end of the cable;

wherein the first and second connectors each comprise a non-conductive housing, an alignment element associated with the pin-receptacle-supporting face, and nine pin receptacles supported on the pin-receptacle-supporting face, the pin receptacles each electrically coupled with one of the conductors;

wherein the pin receptacles include a center pin receptacle and a plurality of outer pin receptacles circumferentially-spaced around the center pin receptacle in a symmetrical fashion;

wherein the outer pin receptacles comprises a first pin receptacle, a second pin receptacle, a third pin receptacle, a fourth pin receptacle, a fifth pin receptacle, a sixth pin receptacle, a seventh pin receptacle, and an eighth pin receptacle; and wherein a third conductor and a fourth conductor are formed into a first twisted pair, a first conductor and a second conductor are formed into a second twisted pair, a seventh conductor and a eighth conductor are formed into a third twisted pair, and a fifth conductor and a sixth conductor are formed into a fourth twisted pair.

2. The Ethernet cable assembly of claim 1, wherein the first twisted pair is complementary to the fourth twisted pair and the second twisted pair is complementary to the third twisted pair.

3. The Ethernet cable assembly of claim 2, wherein the first and second connectors comprise center pin receptacles configured to serve as a drain and a ninth conductor extending between the center receptacles of the first and second connectors are configured to serve as a shield.

4. The Ethernet cable assembly of claim 1, wherein the first conductor is configured to carry a BI_DA+ data signal, and wherein the fourth conductor is configured to carry a BI_DC− data signal.

5. The Ethernet cable assembly of claim 1, wherein the second conductor is configured to carry a BI_DA− data signal, and wherein the third conductor is configured to carry a BI_DC+ data signal.

6. The Ethernet cable assembly of claim 1, wherein the fifth conductor is configured to carry a BI_DD− data signal, and wherein the sixth conductor is configured to carry a BI_DD+ data signal.

7. The Ethernet cable assembly of claim 1, wherein the seventh conductor is configured to carry a BI_DB− data signal; and wherein the eighth conductor is configured to carry a BI_DB+ data signal.

8. An Ethernet cable assembly comprising:

a cable including nine conductors;

a first connector coupled with a first end of the cable;

a second connector coupled with a second end of the cable; and a coupler configured for physically and electrically connecting to either the first connector or the second connector;

wherein the first and second connectors each comprise a non-conductive housing, an alignment element associated with the pin-receptacle-supporting face, and nine pin receptacles supported on the pin-receptacle-supporting face, the pin receptacles each electrically coupled with one of the conductors;

wherein the pin receptacles include a center pin receptacle and a plurality of outer pin receptacles circumferentially-spaced around the center pin receptacle in a symmetrical fashion;

wherein the outer pin receptacles comprises a first pin receptacle, a second pin receptacle, a third pin receptacle, a fourth pin receptacle, a fifth pin receptacle, a sixth pin receptacle, a seventh pin receptacle, and an eighth pin receptacle.

9. The Ethernet cable assembly of claim 8, wherein the coupler comprises a non-conductive housing having first and second ends and at least one alignment element that cooperatively mates with the alignment elements on the first and second connectors.

10. The Ethernet cable assembly of claim 9, wherein the coupler further comprises nine elongated pins extending between the first and second ends of the housing, the pins arranged to physically and electrically couple with the pin receptacles of the first or the second connectors when either the first or second end of the coupler is connected to either the first connector or the second connector.

11. The Ethernet cable assembly of claim 8, further comprising a plastic collar having threads formed therein, wherein the non-conductive housings of at least one of the coupler and the first and second connectors have screw threads formed thereon, wherein the threads of the plastic collar engage with the threads of the non-conductive housings to attach the coupler with the first connector or the second connector.

12. The Ethernet cable assembly of claim 9, wherein the plastic collar forms a waterproof connection with the coupler, an o-ring, and the first or second connector.

13. The Ethernet cable assembly of claim 8, wherein the non-conductive housings of the first and second connectors and the coupler are made of plastic, wherein when the non-conductive housing of the coupler forms a waterproof connection with the non-conductive housing of the first or second connectors when the pins of the coupler are seated in the pin receptacles of the first or second connector.

14. The Ethernet cable assembly of claim 8, wherein the first alignment element of at least one of the connectors comprises an alignment protrusion and the second alignment element of the coupler comprises an alignment indention configured to slidably mate with the alignment protrusion.

15. The Ethernet cable assembly of claim 8, wherein the first alignment element of at least one of the connectors comprises an alignment indention and the second alignment element of the coupler comprises an alignment protrusion configured to slidably mate with the alignment indention.

* * * * *